US005396271A

United States Patent [19]

Premnath

[11] Patent Number: 5,396,271

[45] Date of Patent: Mar. 7, 1995

[54] WIPER BLADE CLEANING SYSTEM FOR NON-COPLANAR NOZZLE FACES OF INK JET PRINTHEADS

[75] Inventor: Karai P. Premnath, Rochester, N.Y.

[73] Assignee: Xerox Corporation, Stamford, Conn.

[21] Appl. No.: 974,765

[22] Filed: Nov. 12, 1992

[51] Int. Cl.[6] ..... B41J 2/165

[52] U.S. Cl. ..... 347/33; 347/36

[58] Field of Search ..... 346/140 R; 347/33, 36

[56] References Cited

U.S. PATENT DOCUMENTS

| | | | |
|---|---|---|---|
| Re. 32,572 | 1/1988 | Hawkins et al. | 156/626 |
| 4,030,159 | 6/1977 | Centoducati | 15/250.42 |
| 4,364,065 | 12/1982 | Yamamori et al. | 346/140 R |
| 4,571,599 | 2/1986 | Rezanka | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 5,065,158 | 11/1991 | Nojima et al. | 346/140 R |
| 5,151,715 | 9/1992 | Ward et al. | 346/140 R |

FOREIGN PATENT DOCUMENTS

| | | |
|---|---|---|
| 62-101447 | 5/1987 | Japan . |
| 04126259 | 4/1992 | Japan . |

*Primary Examiner*—Benjamin R. Fuller
*Assistant Examiner*—V. Lund
*Attorney, Agent, or Firm*—Robert A. Chittum

[57] ABSTRACT

A wiper blade cleaning system has two polyurethane wiping blades of unequal lengths, but which are otherwise identical. The blades are releasably mounted in slots on a planar surface of a fixed structural member. The mounted blades are parallel and spaced apart a predetermined distance. The positioning of the blades is dependent on the order in which they must act on the nozzle face of the printhead as it leaves the priming station, so that the shorter blade cleans first. The shorter blade is stiffer because of its shorter length and serves to remove ink efficiently off of the printhead nozzle face. However, when cleaning a non-coplanar nozzle face, small amounts of ink collected on the shorter blade cleaning edge may be deposited in crevices or other discontinuities on the non-coplanar nozzle face. The longer blade is more compliant because of its added length and follows in the wake of the shorter blade to remove the last vestige of ink left by the stiffer, shorter blade.

4 Claims, 5 Drawing Sheets

WIPER BLADE CLEANING SYSTEM FOR NON-COPLANAR NOZZLE FACES OF INK JET PRINTHEADS

BACKGROUND OF THE INVENTION

The present invention relates to ink jet printing apparatus and is concerned with the printing apparatus maintenance system for a printhead in such apparatus. More particularly, this invention relates to cleaning of ink jet printheads having non-coplanar nozzle faces.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 4,855,764; 4,853,717 and 4,746,938 while the removal of gas from the ink reservoir of a printhead during printing is described in U.S. Pat. No. 4,679,059.

It has been found that the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress and, like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped.

U.S. Pat. No. 5,151,715 to Ward et al. discloses a printhead wiper for ink jet printers molded from an elastomer and including a wiping beam having a wiping edge formed at one end of the beam. The other end of the beam is integral with a base. A hole through the beam near the base decreases beam stiffness. A higher durometer elastomer may thus be used without applying excessive wiping force to the printhead. In another embodiment, the wiper includes a pair of wiping blades each of which have wiping edges for wiping a printhead traveling thereby. The first wipe removes pooled ink and debris and spread viscous ink while the second wipe furthers the spread of ink before it can retract to its former drop or pooled configuration.

U.S. Pat. No. 4,364,065 to Yamamori et al. discloses a nozzle moistening device to prevent clogging of the nozzle of an ink jet writing head, which includes an elastic enclosure fluid-tightly engageable with the front face of the writing head when not in use, a source of water, and a capillary tube for transmitting water from the source to the enclosure by capillary action to permit evaporation of water in the enclosure to moisten the nozzle. FIG. 6 therein discloses a multi-bladed wiping device.

U.S. Pat. No. 5,065,158 to Nojima et al. discloses a cleaning member positioned to bear against the discharge port forming surface of an ink jet recording head, which contains the discharge ports therein, to thereby clean the discharge port forming surface. The cleaning member is formed of a material composed chiefly of hydrogenated nitrile butadiene rubber.

SUMMARY OF THE INVENTION

It is an object of the present invention to provide an effective blade cleaning device for cleaning ink jet printheads having non-coplanar nozzle faces.

In the present invention, two polyurethane wiping blades of unequal lengths, but otherwise identical, are releasably mounted in slots on a planar surface of a fixed structural member. The mounted blades are parallel and spaced apart a predetermined distance. The positioning of the blades is dependent on the order in which they must act on the nozzle face of the printhead as it leaves the priming station, so that the shorter blade cleans first. The shorter blade is stiffer because of its shorter length and serves to remove ink efficiently off of the printhead nozzle face. However, because of its stiffness, the shorter blade tends to chatter across the non-coplanar nozzle face and small amounts of ink collected on the shorter blade cleaning edge are deposited in crevices, pockets, or other interfaces of adjacent discontinuities on the non-coplanar nozzle face. The longer blade is more compliant because of its added length and follows in the wake of the shorter blade to remove the last vestige of ink left by the stiffer, shorter blade.

The foregoing and other objects, features, and advantages of the invention will become more readily apparent from the following detailed description of a preferred embodiment wherein like index numerals indicate like parts.

DESCRIPTION OF THE PREFERRED EMBODIMENT

Figure 1:
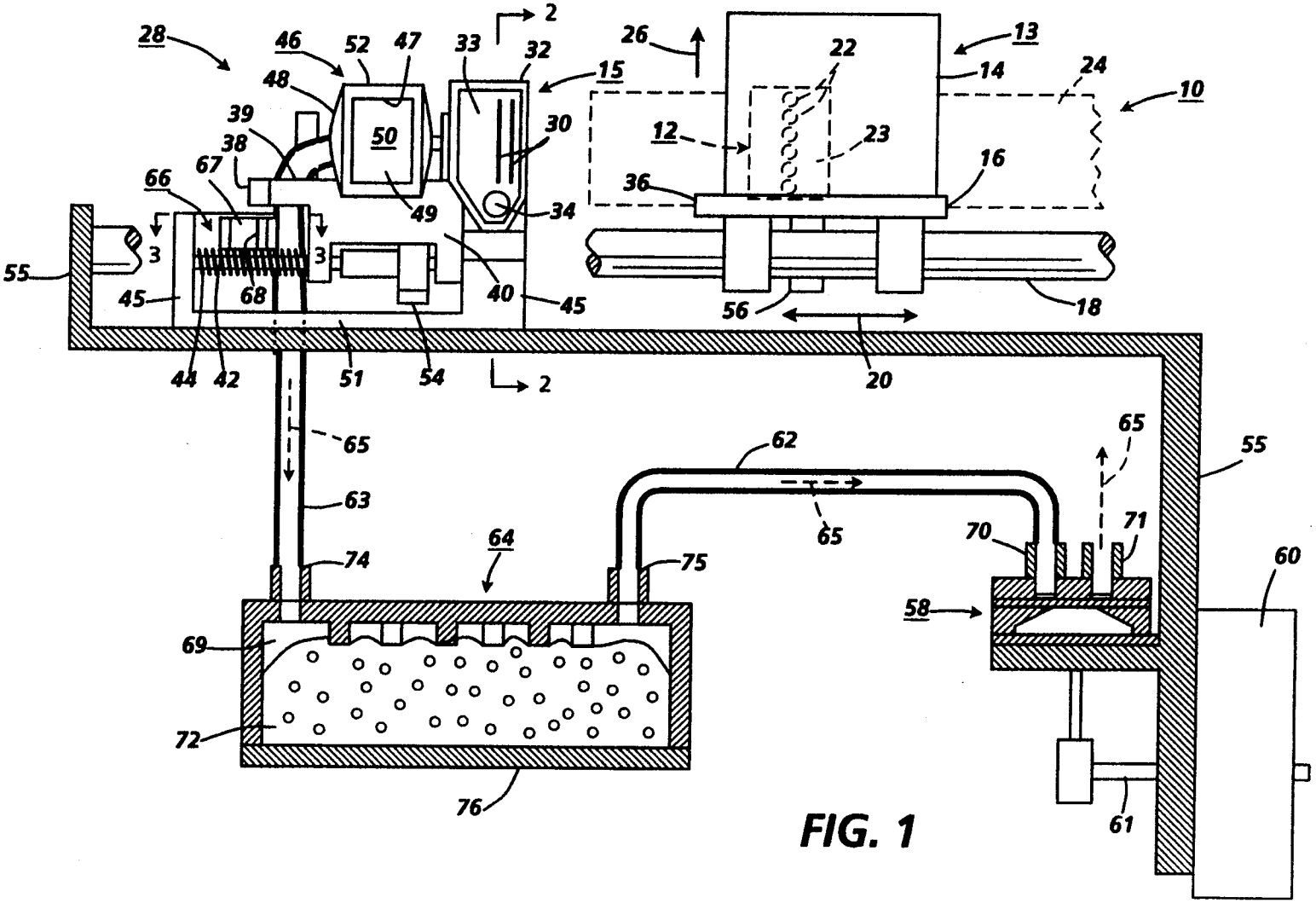
FIG. 1 is a schematic front elevation view of a partially shown ink jet printer having a maintenance incorporating the cleaning blade assembly of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past the wiper blade cleaning assembly 15 of the present invention comprising two releasably mounted wiper blades 30, 31 in a fixed structural member 32, more fully discussed later, so that the printhead nozzle face 23 is wiped free of ink and debris every time the printhead and cartridge (hereinafter print cartridge 13) enters or exits the maintenance station. Adjacent the wiper blades in the direction away from the printing zone and at a predetermined location along the translating path of the print cartridge is a collection surface 33 in the fixedly mounted structural member 32. The carriage will position the print cartridge at this collection surface, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the wiper blade assembly, cleaning the nozzle face, and to the predetermined location confronting the collection surface 33, whereat the printer controller causes the printhead to eject a number of ink droplets per nozzle therein. In the preferred embodiment, the printhead will eject about 25 ink droplets per nozzle onto the collection surface. Since the collection surface is located within the structural member 32 and adjacent the wiper blades 30, 31, ink may run or drip off the blades and be collected on the collection surface which is substantially parallel to the printhead nozzle face and oriented in a direction so that the force of gravity causes the ink to collect in the lower portion thereof, where an opening 34 is located for the ink to drain therethrough into a pad of absorbent material 41 (shown in FIG. 2) behind the collection surface 33 of the structural member 32.

When the carriage 16 continues along guide rails 18 beyond the structural member with the wiper blades for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the structural member 32 by spring 44 which surrounds guide rail 42. The cap 46 has a closed wall 47 extending from a bottom portion 48 of the cap to provide an internal recess 49 having a piece of absorbent material 50 therein. The top edge of the wall 47 is covered by a resilient material to form a seal 52. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62, 63 and an ink separator 64 is located intermediate the cap and vacuum pump.

Figure 3:
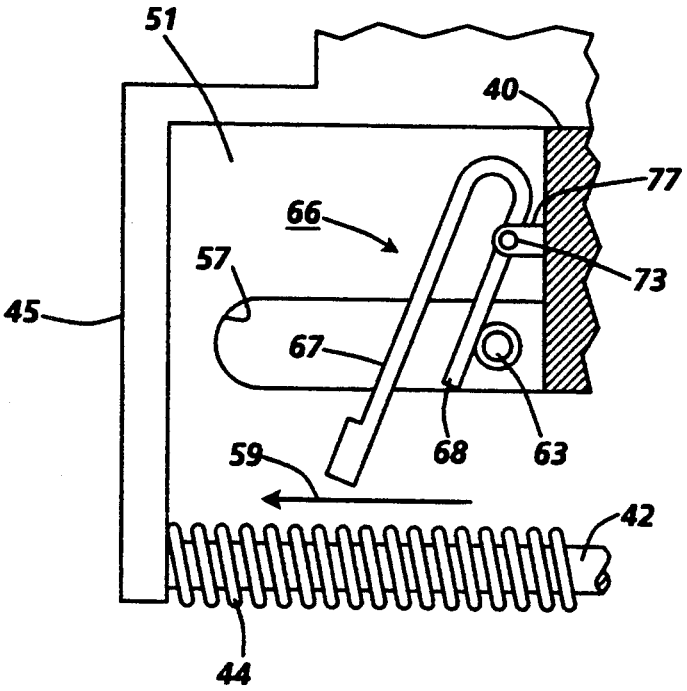
FIG. 3 is a cross-sectional view as viewed along section line 3—3 of FIG. 1.

The cap carriage guide rail 42 is fixedly positioned between fixed upstanding support members 43, 45 which extend from base 51 removably attached to the printer frame 55. Referring to FIG. 3, a cross sectional view taken along view line 3—3 of FIG. 1, base 51 has an elongated slot 57 for passage of the flexible hose 63 and to accommodate movement therein. A pinch valve 66 having a U-shaped structure is rotatably attached to the cap carriage 40 by a fixed cylindrical shaft 73 on leg 68 of the U-shaped structure, which is pivoted in flanges 77, so that movement of the cap carriage toward upstanding support member 45, as indicated by arrow 59, will eventually bring the other leg 67 of the U-shaped structure into contact with fixed support member 45, pinching the flexible tube 63 closed.

Thus, at one predetermined location along guide rails 18, the print cartridge, through engagement of the carriage actuator edge 36 and catch 38 of the cap carriage, will cause the printhead nozzle face to be capped, but the tube 63 will not be pinched shut. This will be referred to as the capped position, and the nozzle face is subjected to humidified, ambient pressure air through the cartridge vent (not shown) and vacuum pump valves 70, 71 through separator 64.

When it is necessary to prime the printhead, the carriage 16 is moved from the capped position towards fixed support member 45 until leg 67 of U-shaped pinch valve 66 contacts support member 45 causing the U-shaped pinch valve to rotate, so that leg 68 of the U-shaped structure pivots against flexible hose 63 and pinches it closed, i.e., pinch valve 66 is caused to close flexible hose 63 by movement of the carriage 16. Paper feed motor 60 is energized and diaphragm vacuum pump 58 evacuates separator chamber 69, partially filled with an absorbent material, such as reticulated polyurethane foam 72, to a negative pressure of about minus 120 inches of $H_2O$. This negative pressure is attained in about 18 seconds. Meanwhile the cap recess is still at ambient pressure because of the pinch valve closure. When the desired separator negative pressure is achieved, after about 18 seconds, the carriage is returned to the location where the nozzle face is capped, but the flexible hose 63 is no longer pinched closed; i.e., in the capped position. At this point, the cap is still sealed to the printhead nozzle face and the pinch valve is opened thereby subjecting the sealed cap internal recess to a negative pressure of minus 120 inches of $H_2O$. The print cartridge remains at this position for about one second. This time period is determined to achieve a specific relationship of pressure in the cap and flow impedance of the ink through the nozzles and the maintenance system air volume in order to yield a priming target of 0.2 cc$\pm$0.05 cc of ink. The pinch valve pinches the flexible hose 63 closed at time zero seconds, and with the vacuum pump running, causes the pressure to begin dropping in the separator 64. The cap 46 is sealed to the printhead nozzle face 23 and no pressure is reduced in the cap because the flexible hose is pinched closed. After about 18 seconds, the cap carriage 40 is allowed to move in a direction away from support member 45 under the urging of spring 44 when the print cartridge carriage 16 is moved in a direction toward the wiper blade cleaning assembly 15, back to the capping position. After about 18 seconds from the flexible hose pinch off, the negative pressure from the separator is introduced to the cap and ink is sucked from the nozzles. The negative pressure begins to drop slightly due to the flow of ink. After about one second, the carriage 16 then moves, breaking the cap seal and stopping the priming. The cap pressure drops and returns to ambient. The print cartridge is moved past the wiper blades 30, 31 to a hold position adjacent the wiper blade assembly 15 at a location between the wiper blade assembly and the printing zone for a predetermined time period to wait while the ink and air are sucked or purged from the cap to the separator. When this has been accomplished, the carriage returns the print cartridge to the capped position to await for a printing mode command from the printer controller.

Optionally, a manual prime button (not shown) is provided on the printer for actuation by a printer operator when the printer operator notices poor print quality caused by, for example, a nozzle that is not ejecting ink droplets. This manual priming by actuation of the manual prime button works substantially the same way as the automatic prime sequence described above, which is generally performed when the print cartridge is installed or any other sensed event which is programmed into the printer controller. The only difference is that the amount of lapsed time is reduced to 0.5 seconds after the pinch valve is opened to reduce the amount of ink sucked from the print cartridge to about 0.1 cc to reduce waste ink and prevent reduced printing capacity per print cartridge.

While the cap is being purged of ink and the print cartridge is in the hold position, the paper feed motor is operating the vacuum pump to pump air and ink from the cap into the separator. Once in the separator, the ink is absorbed by the foam which stores the ink and prevents ink from entering the pump. (Ink in the pump could damage pump valves.) Above the foam in the separator is a chamber having a serpentine air passageway which connects the inlet 74 and outlet 75 of the separator. This passageway makes it impossible for airborne ink to reach the outlet 75 which could lead to ink ingestion by the pump. The floor 76 of the separator is made of a material that is strategically selected for its Moisture Vapor Transfer Rate (MVTR). During months of use, fluid will be lost through this migration phenomena. Any time the paper feed motor is turning for any reason other than maintenance, the print cartridge must be away from the cap, otherwise unwanted ink would be drawn into the cap. When the paper feed motor is turning for reasons other than maintenance, and the printer cartridge is away from the cap, the pump operates and continues to pump air through the maintenance station system purging ink from the cap to the separator. This provides extra insurance which prevents ink from collecting in flexible hose 63, drying and blocking flow therethrough.

Figure 4:
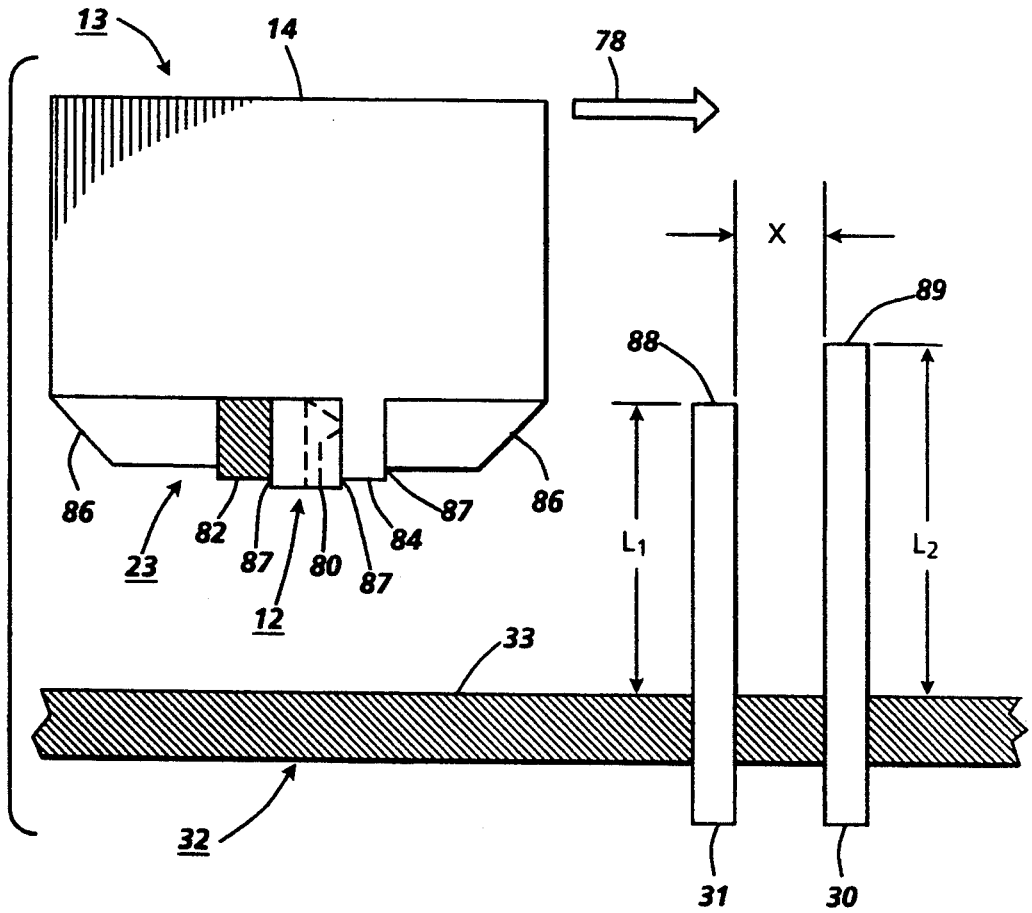
FIG. 4 is a schematic plan view showing the printhead as it exits from a priming location and approaches the cleaning blade assembly.
Figure 5:
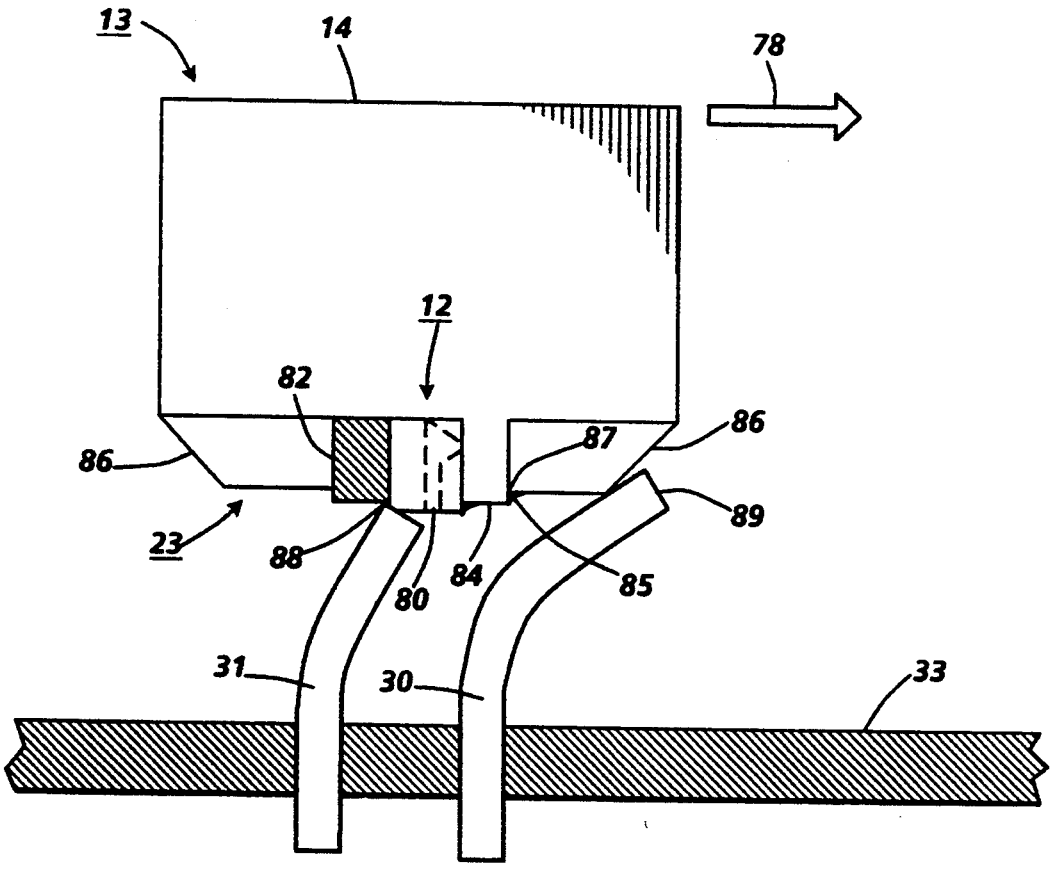
FIG. 5 is a schematic plan view showing the printhead nozzle face being cleaned by the cleaning blade assembly.

Referring to FIGS. 4 and 5, nozzle face 23 comprises a combination of components; viz., the printhead face 80 of printhead 12 containing the nozzles, heat sink 82 to which the printhead is attached, the cartridge interface portion 84 which contains the ink passageway (not shown) between the ink supply in the cartridge and the printhead, and a surrounding face plate 86 to seal around the periphery of the heat sink, printhead, and cartridge interface portion. When a print cartridge is primed, ink is left on the nozzle face, which includes the printhead face, heat sink, cartridge interface portion, and face plate. The amount of ink left on the nozzle face can be substantial. Left uncleaned, the ink on the nozzle face can smear on the recording medium, such as paper, and the result is unacceptable print quality. Also, ink left on the printhead face can dry and affect ink droplet directionality, another important print quality factor.

The surface topography of: the nozzle face 23 is discontinuous and non-coplanar because it contains a plurality of assembled parts. When the nozzle face is non-coplanar, special problems are posed for a wiper blade in sweeping ink thereoff. As the wiper blade sweeps across a surface, it is successful in removing the ink film, unless it is confronted by either raised or lowered surfaces.

Thus, as the typical wiper edge either lifts or drops as it moves across a non-coplanar surface, it can deposit some of the ink that is present on the cleaning edge of the wiper blade on the crevices or corners formed between such discontinuities.

In the present invention, the specific relationship, geometries, and material of the wiper blades 30, 31 overcome the inadequate cleaning encountered with prior art wiping blades. After a print cartridge 13 has undergone a prime operation, the print cartridge disengages from the cap 46 and proceeds towards a position in the direction of arrow 78 intermediate between the capped position and the wiper blade assembly 15 where it resides for about 6 seconds. This waiting period enables much of the ink residing near the nozzles to be retracted back into the printhead due to the capillary and other negative pressure forces present in the nozzles 22 and the cartridge 14. The print cartridge next proceeds toward the wiper blade assembly 15 at about 7.5 inches per second (ips). In this wiping scheme, therefore, the shorter blade 31 precedes the longer blade 30 in its cleaning action. The stiffer, shorter blade serves to remove ink efficiently off the front surface of the printhead face 80 and most of the ink off the other components making up the nozzle face as well. However, due to its stiffness, and because the surface topography of the printer cartridge nozzle face is characterized by discontinuities, the shorter blade can chatter and small amounts of ink 85 that had collected on the blade edge 88, as shown in FIG. 5, are deposited in pockets 87. In this invention, the longer, complaint wiper blade 30 that follows in the wake of the shorter blade 31 removes the last vestige of ink remaining on the nozzle face. Thus, the two blades 30, 31 complement one another. The shorter, more efficient, stiffer blade succeeds in removing the lion's share of the ink off the front face of the cartridge, but it can leave some ink behind. The longer, less stiff blade has limited ink removal capability, but it is superior in handling non-coplanar surfaces and removes the ink that is left behind by the shorter blade through is conformability about surface discontinuities or irregularities.

FIG. 4 shows the basic construction of the complementary dual wiper blades in the wiper blade cleaning assembly and its relationship to the structural member 32. In the preferred embodiment, spacing "x" between the wiper blades 30, 31 is about 3 mm, and the respective heights $L_1$ and $L_2$ of the shorter and longer wiper blades 31, 30 are 5.0±0.25 mm and 5.5±0.25 ram, respectively.

FIG. 5 shows the order in which the wiping action of the shorter and longer wiper blades take place. The wiper blades are substantially identical except for the distances $L_1$ and $L_2$ which extend above collection surface 33 of structural member 32. The shorter blade 31 is, because of its shorter cantilevered distance, stiffer than longer blade 30 and is stiff enough to clean the printhead face 80 of ink, but may divest itself of ink as it rides over the various other non-coplanar surface making up the nozzle face 23.

Figure 2:
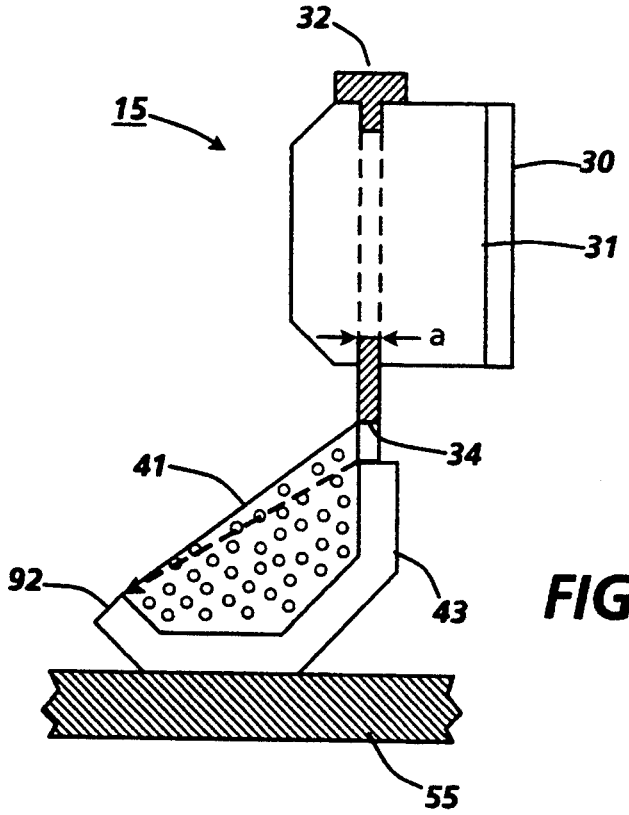
FIG. 2 is a cross-sectional view as viewed along section line 2—2 of FIG. 1.
Figure 6:
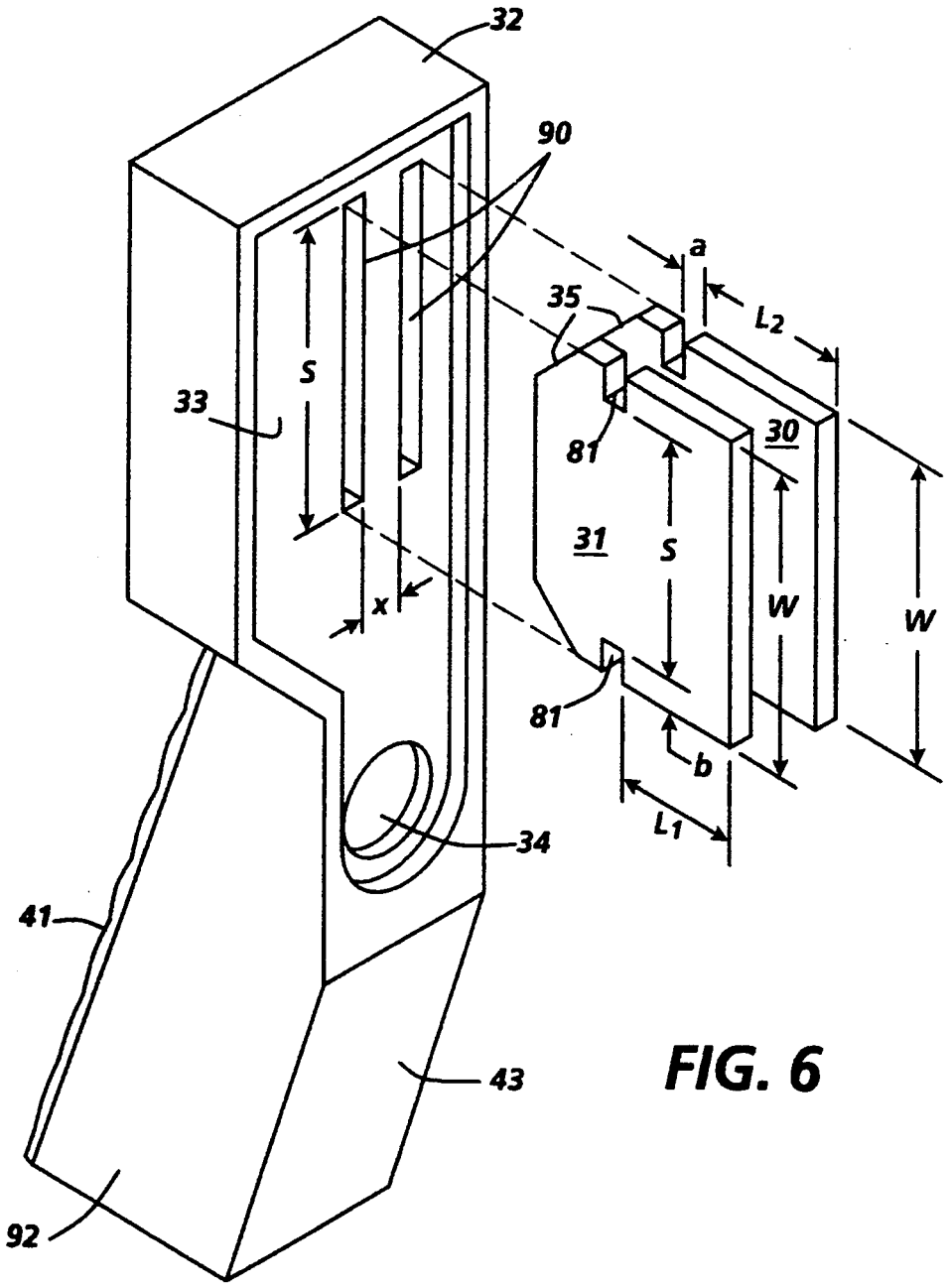
FIG. 6 is an enlarged isometric exploded view of the cleaning blade assembly.

FIG. 2 is a cross-sectional view of the wiper blade cleaning assembly 15 as viewed along section line 2—2 of FIG. 1, and FIG. 6 is an enlarged isometric, exploded view of the blade cleaning assembly, showing the tapered ends 35 for easy insertion into slots 90 in the collection surface 33 of structural member 32.

The blades in the preferred embodiment were empirically optimized from a sheet of polyurethane ester type material having a 70±5 shore A durometer and a thickness of 1.05±0.1 min. The edges 88, 89 are skived to have very short radii, and the blades have a width "w" of about 18.4 min. The slots 90 in the structural member are parallel and have the spacing "x" of about 3 min. The thickness "a" of the planar portion is equal to the width "a" in the notches 81 of the blades and the slots each have a width equal to the thickness of the blades, so that once the blades are forced into the slots having lengths "s" equal to about 16 mm, which is also the distance between the blade notches, the blades are tightly but releasably held in place. The depth "b" of the notches is equal to the blade width "w" minus the distance between notches "s" divided by two, which in the preferred embodiment is 1.2 min.

Ink which drops from the blades and ink droplets ejected against the planar collection surface 33 of structural member 32 are pulled under the influence of the force of gravity towards the lower portion of the structural member where opening 34 directs the ink to an absorbent material 41 held in a recess at the back portion 92 of the structural member.

Many modifications and variations are apparent from the foregoing description of the invention, and all such modifications and variations are intended to be within the scope of the present invention.

I claim:

1. A fixed wiper blade assembly located in a maintenance station for an ink jet printer having a printhead with nozzles in a nozzle face which is mounted on a translatable carriage for concurrent reciprocal movement therewith from a printing zone to selected locations within the maintenance station, the maintenance station having a cap to seal the printhead nozzles at a capping location and having means to place a negative pressure in the cap to prime the printhead, the wiper blade assembly being positioned at a predetermined location within the maintenance station for cleaning ink and other debris from the nozzle face when the carriage moves the printhead thereby, the wiper blade assembly comprising:

two separate elastomeric planar wiping blades, each of said blades having a pair of opposed planar surfaces with an identical thickness therebetween, two opposing parallel side surfaces, and a first end surface and a second end surface, each of said side surfaces of each said blades having an identical notch therein a predetermined distance from the first end surface, so that the notches of each of said blades separated by a predetermined distance;

a fixed structural member in the maintenance station having a planar surface thereon through which a pair of identical, parallel slots penetrate, the slots being separated by a predetermined distance, the structural member having a collection surface on and coplanar with the planar surface, the collection surface being adjacent to the slots and being used to collect ink droplets ejected from the printhead to keep the nozzles clear of dried ink;

the first end surface of each of said blades being inserted through a one of the structural member slots to position the notches of the blades therein, the slots having identical lengths and widths, the slots lengths being substantially equal to the distance separating the blade notches and the slots widths being substantially equal to the blade thickness, so that the blades are releasably mounted on the fixed structural member parallel with each other, a predetermined distance apart, and substantially normal to the planar surface thereon, the second end surface of each of said blades having parallel edges, the blades being identical except one blade is longer than other blade by a predetermined distance, whereby the shorter blade is stiffer to remove ink efficiently from the nozzle face, except where the nozzle face is adjacent to various other non-coplanar surfaces of the nozzle face which produce pockets where ink may reside, while the longer blade is more compliant and removes ink left by the shorter blade; and the planar surface with the collection surface being positioned so that a force of gravity causes ink on the blades to move towards the planar surface and then into a lower portion thereof and any ink ejected onto the collection surface from the printhead nozzles also being directed by the force of gravity towards the lower portion of the planar surface, the structural member and planar surface thereon having an opening therethrough in the lower portion thereof to drain any ink accumulated therein.

2. The wiper blade assembly of claim 1, wherein the structural member further comprises an absorbent material adjacent the opening in the structural member and collection surface thereon to absorb any ink travelling through the opening in the structural member and collection surface.

3. The wiper blade assembly of claims 2, wherein the structural member has a front and surface back surfaces, the front surface being the planar surface with the collection surface, and the absorbent material is located against the back surface of the structural member and over the opening in the structural member and collection surface.

4. The wiper blade assembly of claim 1, wherein the printhead is moved, after a prime of the printhead, to a location intermediate the cap location and the wiper blade assembly and held momentarily for a relatively short predetermined time to enable at least some of the ink on the nozzle face to be retracted back into the printhead prior to proceeding past the wiper blade assembly in order to increase the cleaning efficiency to said wiper blade assembly.

* * * * *